US009809412B2

(12) United States Patent
Shirasaki

(10) Patent No.: US 9,809,412 B2
(45) Date of Patent: Nov. 7, 2017

(54) SHEET FOLDING APPARATUS AND SHEET POST-PROCESSING APPARATUS

(71) Applicant: KYOCERA Document Solutions Inc., Osaka (JP)

(72) Inventor: Seiichi Shirasaki, Osaka (JP)

(73) Assignee: KYOCERA Document Solutions Inc., Osaka (JP)

( * ) Notice: Subject to any disclaimer, the term of this patent is extended or adjusted under 35 U.S.C. 154(b) by 497 days.

(21) Appl. No.: 14/510,361

(22) Filed: Oct. 9, 2014

(65) Prior Publication Data

US 2015/0119223 A1 Apr. 30, 2015

(30) Foreign Application Priority Data

Oct. 30, 2013 (JP) ..... 2013-224930

(51) Int. Cl.
*B65H 45/16* (2006.01)
*B65H 45/18* (2006.01)

(52) U.S. Cl.
CPC ..... *B65H 45/16* (2013.01); *B65H 45/18* (2013.01); *B65H 2404/1316* (2013.01)

(58) Field of Classification Search
CPC B65H 45/16; B65H 45/18; B65H 2404/1316; B65H 45/14; B65H 45/144
USPC ..... 493/403, 424, 427, 434, 442, 454, 420
See application file for complete search history.

(56) References Cited

U.S. PATENT DOCUMENTS 538,609 A * 4/1895 Dexter ..... B31B 21/00 493/336
1,606,459 A * 11/1926 Waterworth ..... B65H 45/144 493/420
1,837,661 A * 12/1931 Howard ..... B42C 5/00 493/444

(Continued)

FOREIGN PATENT DOCUMENTS

JP 2004-123245 A 4/2004
JP 2004123245 A * 4/2004

(Continued)

OTHER PUBLICATIONS

An Office Action; "Notice of Reasons for Rejection," issued by the Japanese Patent Office on Feb. 2, 2016, which corresponds to Japanese Patent Application No. 2013-224930 and is related to U.S. Appl. No. 14/510,361.

*Primary Examiner* — Hemant M Desai
*Assistant Examiner* — Lucas Palmer
(74) *Attorney, Agent, or Firm* — Studebaker & Brackett PC

(57) ABSTRACT

A sheet folding apparatus having two-folding rollers each of whose outer diameter gradually decreases from the central part to each end part, a folding plate which can move forward to or backward from a nip between the two-folding rollers, and has a cutout part located at an edge part of the folding plate facing the nip between central parts of the two-folding rollers, wherein the cutout part does not reach the nip between the central parts of the two-folding rollers when the sheets are folded, and a folding plate support member which is placed at a position facing the nip between the central parts of the two-folding rollers, and can slide in a direction of moving closer to or away from the nip, wherein the folding plate support member projects from the (Continued)

cutout part when the sheets are set, and does not reach the nip when the sheets are folded.

6 Claims, 10 Drawing Sheets

(56) References Cited

U.S. PATENT DOCUMENTS 4,419,088 A * 12/1983 Nemec ..... B65H 45/18 493/444
6,003,853 A * 12/1999 Nakazawa ..... B65H 45/12 270/58.08
6,568,668 B1 * 5/2003 Wakabayashi ..... B65H 45/18 270/18
6,868,253 B2 * 3/2005 Ueda ..... B65H 45/18 270/20.1
7,726,638 B2 * 6/2010 Itagaki ..... B65H 45/18 270/20.1
8,105,227 B2 * 1/2012 Hubbard ..... B65H 45/18 270/49
8,177,211 B2 * 5/2012 Iguchi ..... B65H 37/04 270/32
8,915,490 B2 * 12/2014 Izumichi ..... B65H 39/00 270/32
2002/0025207 A1 * 2/2002 Yoshie ..... B65H 45/142 399/407
2008/0001338 A1 * 1/2008 Kotani ..... B65H 45/18 270/37
2008/0150211 A1 * 6/2008 Iguchi ..... B65H 39/10 270/37
2008/0182740 A1 * 7/2008 Fukasawa ..... B65H 45/18 493/405
2008/0315489 A1 * 12/2008 Iguchi ..... B42C 1/12 270/37
2008/0318752 A1 * 12/2008 Oshiro ..... B65H 45/18 493/424
2009/0221412 A1 * 9/2009 Kawaguchi ..... B65H 37/04 493/444
2010/0190629 A1 * 7/2010 Eijkelkamp ..... B65H 45/18 493/445
2011/0316214 A1 * 12/2011 Parks ..... B41F 13/56 270/20.1

FOREIGN PATENT DOCUMENTS

JP 2007-137663 A 6/2007
JP 2007137663 A * 6/2007
JP 2008-207924 A 9/2008
JP 2008207924 A * 9/2008

* cited by examiner

SHEET FOLDING APPARATUS AND SHEET POST-PROCESSING APPARATUS

INCORPORATION BY REFERENCE

This application is based on and claims the benefit of priority from Japanese patent application No. 2013-224930 filed on Oct. 30, 2013, the entire contents of which are incorporated herein by reference.

BACKGROUND

The present disclosure relates to a sheet folding apparatus which folds sheets of paper in two and a post-processing apparatus which includes the sheet folding apparatus.

At present, a sheet post-processing apparatus which has an apparatus which staples or punches sheets on which images are formed by an image forming apparatus, or a sheet folding apparatus which folds such sheets in two is spread.

In general, a sheet folding apparatus which folds sheets in two has a couple of two-folding rollers and a folding plate which can move forward to or backward from a nip between the two-folding rollers. The sheet folding apparatus folds the sheets by pushing the sheets upward with the folding plate so as to insert the sheets between the two-folding rollers and pressing the sheets between the two-folding rollers.

A roller with a column-shaped central shaft and a rubber layer surrounding the shaft is typically used as the two-folding roller. If the roller with such a construction is formed so as to have the uniform outer diameter in a longitudinal direction, the pressing force of each end part of the roller in a longitudinal direction tends to be stronger than that of the central part of the roller because of the deformation of the roller and the like when the two rollers are pressed each other. This causes the problem that force is applied to the sheets from the outer side to the inner side in a width direction when the sheets passes between the rollers, so that the sheets are creased.

In consideration of this, a two-folding roller whose outer diameter is set so as to gradually decrease from the central part to each end part in an axial direction is proposed. In the roller with such a shape, the pressing force is higher at the central part having the large diameter when the two rollers are pressed each other, and the above-described tendency is cancelled each other out, and therefore, a uniform pressing force can be obtained in an axial direction in the rollers.

In a sheet folding apparatus with such two-folding rollers, in the case where the edge of the folding plate does not go over the nip between the two-folding rollers when the sheets are folded in two, the bulging edge part of the folded sheets, which is formed when the sheets are pushed upward and are folded with the folding plate, cannot go over the nip. As a result, the sheets are pushed back from the nip, or, the most outer sheet goes over the nip, and thus, a paper jam occurs, or, if the sheets are stapled, the sheet is torn.

In the case where the edge of the folding plate goes over the nip between the two-folding rollers, the sheets are not pushed back. However, when the folding plate is pulled out from the nip, the friction between the folding plate and the most inner sheet increases between the central parts of the two-folding rollers each having a large diameter, and, as a result, gloss can be produced on the sheet and it causes defects in the images, or the most inner sheet may be pulled back together with the folding plate, so that a paper jam occurs, or the sheet is torn.

In consideration of this, a post-processing apparatus in which a cutout part which is not inserted into the nip is formed in the part of the edge of the folding plate corresponding to the central parts of the two-folding rollers each having a large diameter is proposed.

However, in the post-processing apparatus in which the cutout part is formed in the edge of the folding plate, when one sheet is set between the two-folding rollers and the folding plate, the central part of the sheet is placed on the edge of the folding plate, and, at this time, the part of the sheet corresponding to the cutout part can bend down because of its weight. If the sheet is inserted into the nip between the two-folding rollers with the folding plate in the state where the sheet is bending down, the bent part of the sheet is creased.

If a projected part is formed in the cutout part to prevent the crease of the sheet, the sheet can be set without bending down, and cannot be creased. However, since the projected part is inserted into the nip, gloss can be produced in the part of the sheet corresponding to the projective part when the folding plate is pulled out from the nip, as described above.

SUMMARY

A sheet folding apparatus in accordance with one aspect of the present disclosure is an apparatus which folds a sheet of paper in two and has a couple of two-folding rollers each of whose outer diameter gradually decreases from the central part to each end part in a longitudinal direction thereof, a folding plate which can move forward to or backward from a nip between the two-folding rollers, and has a cutout part which is located in an edge part of the folding plate facing the nip between central parts of the two-folding rollers, wherein the cutout part does not reach the nip between the central parts of the two-folding rollers when the sheet is folded, and a folding plate support member which is placed at a position facing the nip between the central parts of the two-folding rollers, and can slide in a direction of moving closer to or away from the nip, wherein the folding plate support member projects from the cutout part when the sheet is set between the two-folding rollers and the folding plate, and does not reach the nip when the sheet is folded.

A sheet post-processing apparatus in accordance with one aspect of the present disclosure has the above-described sheet folding apparatus.

The above and other objects, features, and advantages of the present disclosure will become more apparent from the following description when taken in conjunction with the accompanying drawings in which a preferred embodiment of the present disclosure is shown by way of illustrative example.

DETAILED DESCRIPTION

Figure 1:
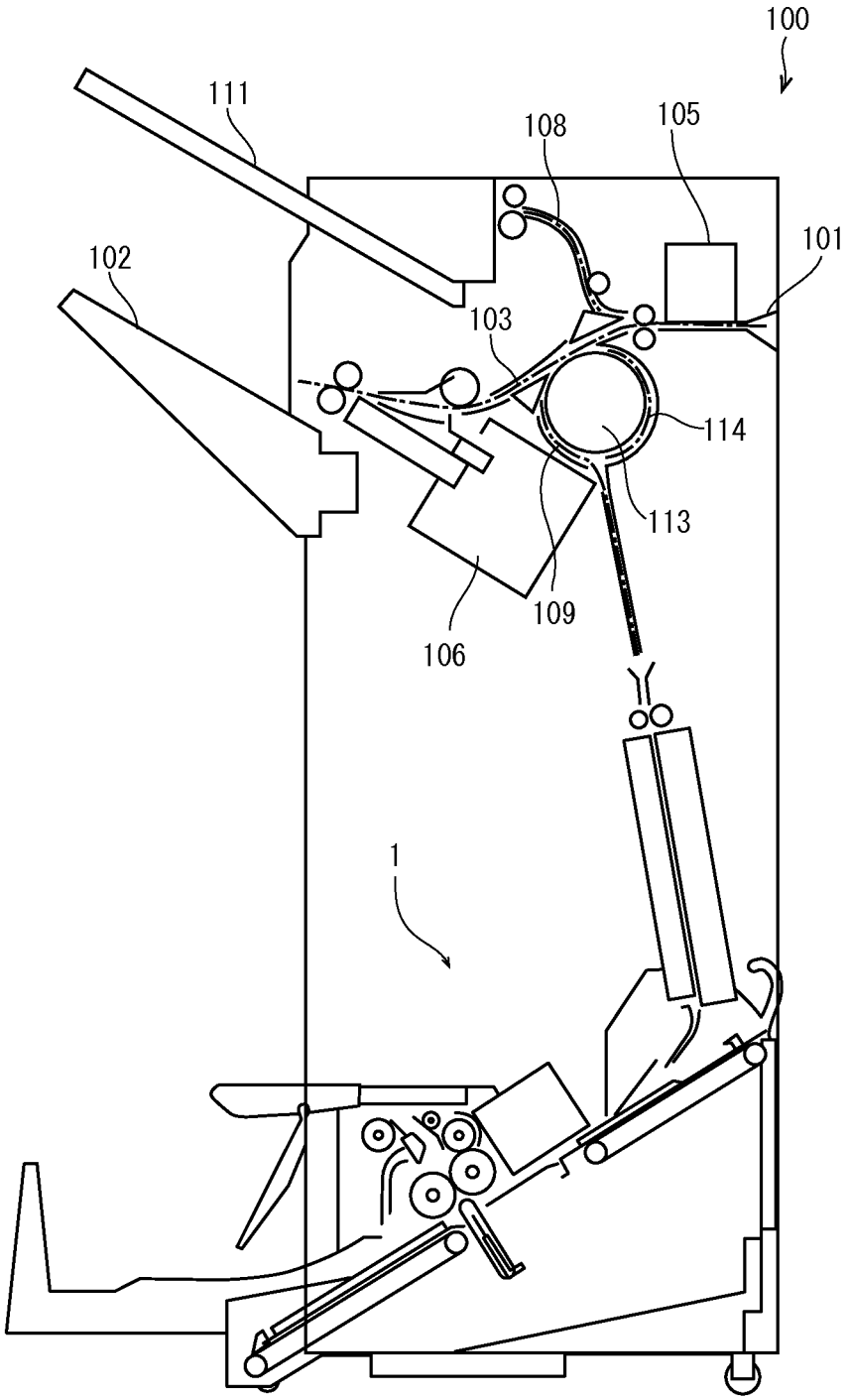
FIG. 1 is a sectional elevation view that schematically shows an embodiment of a sheet post-processing apparatus in accordance with the present disclosure.

Embodiments of a sheet folding apparatus and a sheet post-processing apparatus in accordance with the present disclosure are described below and in the drawings.

The configuration of a sheet post-processing apparatus 100 is described. FIG. 1 is a diagram that schematically shows the configuration of the sheet post-processing apparatus 100. The sheet post-processing apparatus 100 performs a stapling process, a punching process and a two-folding process on sheets of paper on which images are formed by an image forming apparatus.

A carry-in part 101, in which sheets ejected from an image forming apparatus are carried, is formed in a part of one side of the sheet post-processing apparatus 100, and a first ejection tray 102 is placed in apart of the other side of the sheet post-processing apparatus 100. In the inside of the sheet post-processing apparatus 100, a sheet conveyance path 103, which extends from the carry-in part 101 to the first ejection tray 102, is formed, and a punching apparatus 105, which performs a punching process on the sheets, and a stapling apparatus 106, which stacks the sheets and staples the sheets with staples, are arranged along with the sheet conveyance path 103.

A first branch path 108 and a second branch path 109 are separated from the sheet conveyance path 103 between the punching apparatus 105 and the stapling apparatus 106, and extend upward and downward, respectively. A second ejection tray 111 is placed at the downstream end of the first branch path 108. Further, a diverting drum 113, which temporarily diverts the sheets, is placed between the first branch path 108 and the second branch path 109. Furthermore, a diverting path 114, which joins the conveyance path 103, is formed along with the diverting drum 113.

A sheet folding apparatus 1 is placed on the downstream side of the second branch path 109 in the lower part of the sheet post-processing apparatus 100. The sheet folding apparatus 1 performs the staple process or the folding process on the supplied sheets in accordance with a user's selection.

Figure 2:
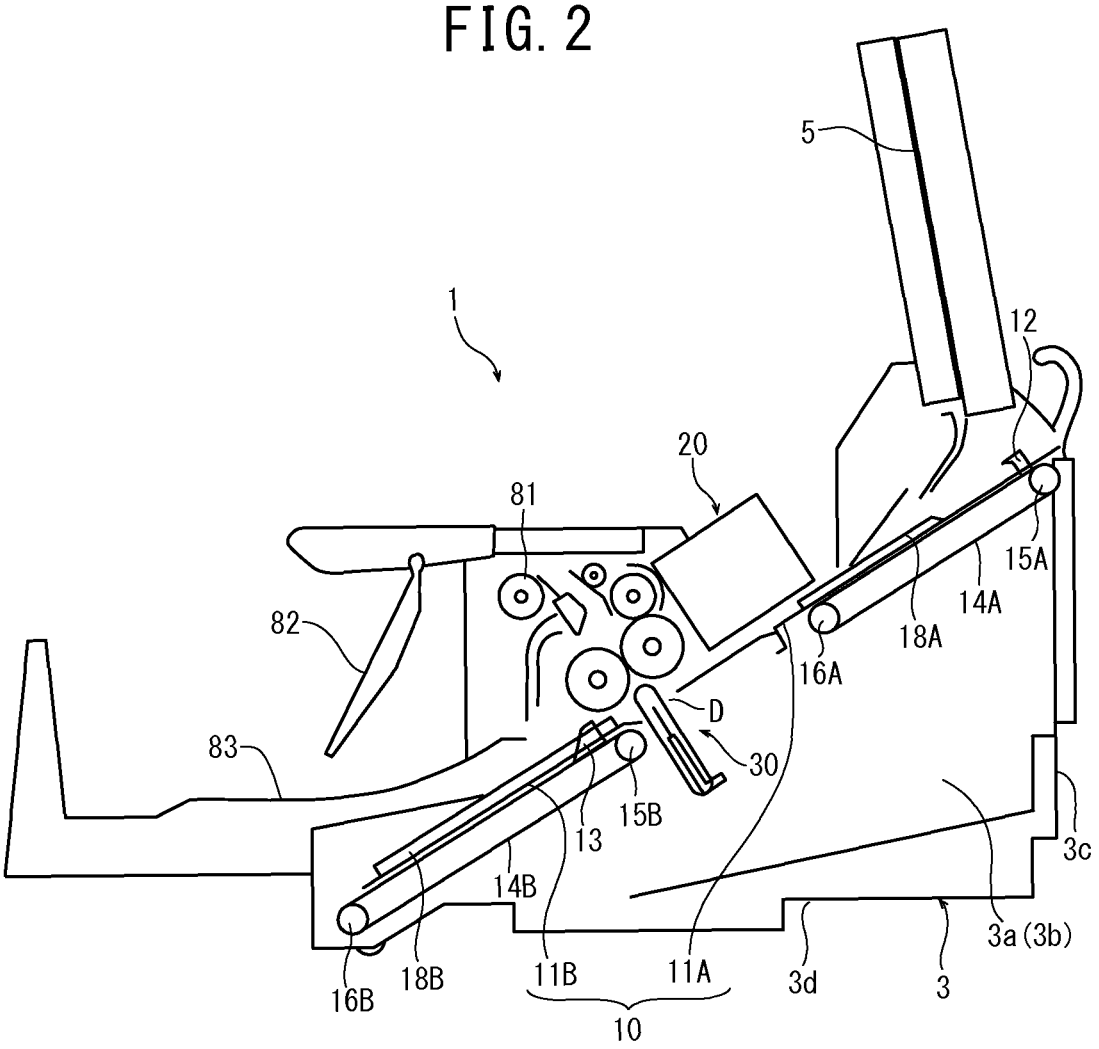
FIG. 2 is a diagram that schematically shows an embodiment of a sheet folding apparatus in accordance with the present disclosure.
Figure 3:
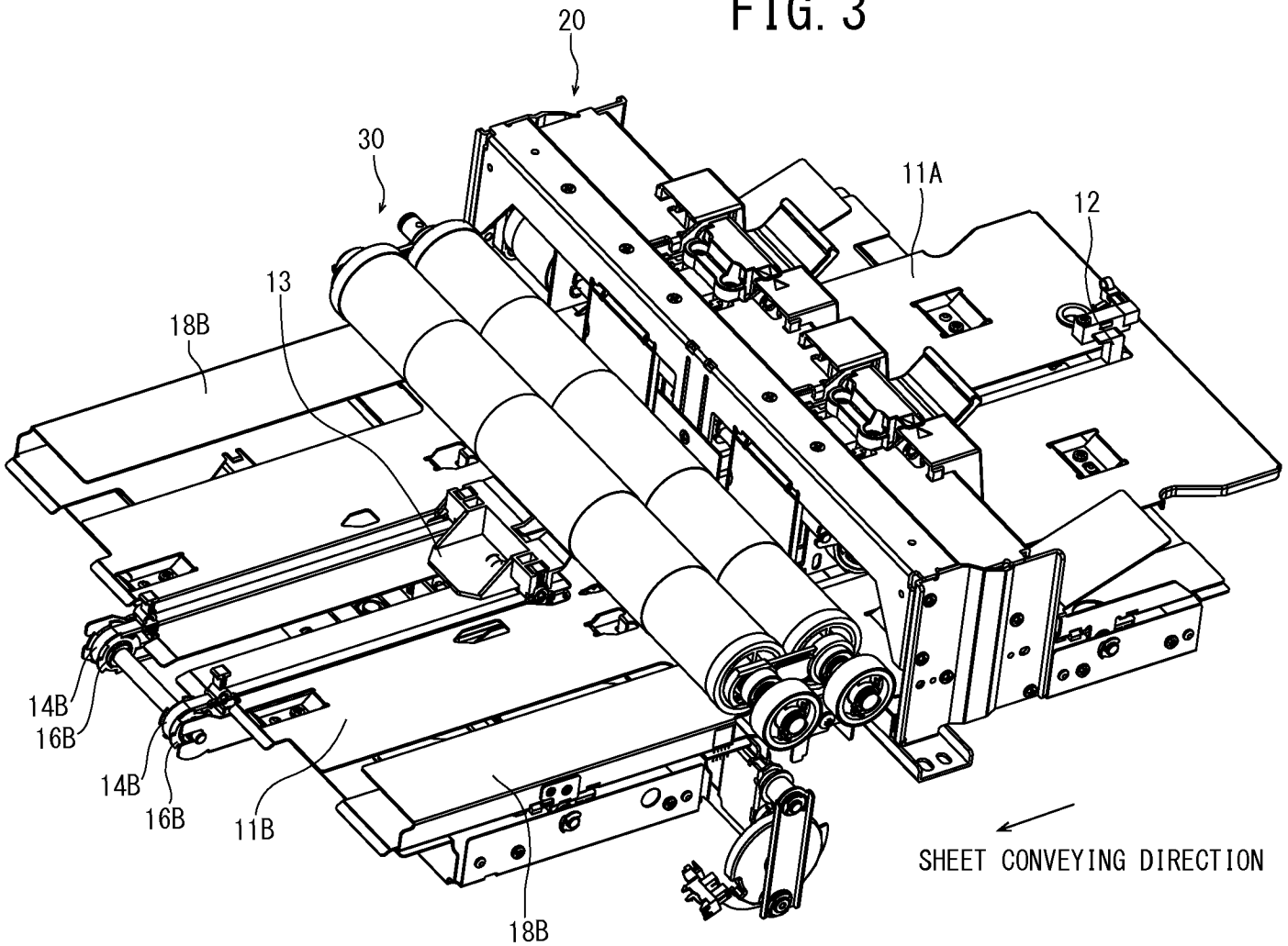
FIG. 3 is a perspective view that shows main parts of an embodiment of a sheet folding apparatus in accordance with the present disclosure.

The sheet folding apparatus 1 is described below and in FIG. 2 and FIG. 3. FIG. 2 is an elevation view that schematically shows the configuration of the sheet folding apparatus, and FIG. 3 is a perspective diagram that shows the inside of the sheet folding apparatus. As shown in FIG. 2, the sheet folding apparatus 1 has a case 3 shaped like a triangle pole set on its side. A sheet carry-in path 5 which is connected with the downstream end of the second branch path 109, a sheet placing member 10 on which sheets carried from the sheet carry-in path 5 are placed and conveyed, a staple apparatus 20 which performs a stapling process on the carried sheets, and sheet folding part 30 which folds sheets in two in the middle of the sheets are supported in the case 3.

The case 3 has front and back side boards 3*a*, 3*b* shaped like a right triangle in a front view, a right side board 3*c*, and bottom side board 3*d*.

The sheet placing member 10 has an upstream sheet placing member 11A and a downstream sheet placing member 11B. Each of the sheet placing members 11A and 11B is formed by using, for example, a member shaped like a board. The upstream sheet placing member 11A and the downstream sheet placing member 11B are arranged between the slanting upper edges of the front and back side boards 3*a* and 3*b* of the case 3 in a straight line in a slanting downward direction. A gap D with a predetermined distance is formed between the sheet placing members 11A and 11B.

A push-out member 12 and a receiving member 13, which align the edges of the upstream side and the downstream side in a sheet conveying direction of the sheets placed in the sheet placing members 11A and 11B, are arranged in the sheet placing members 11A and 11B, respectively. Incidentally, in the explanation described below, "upstream side" and "downstream side" mean the upstream side and the downstream side in the sheet conveying direction, respectively.

The push-out member 12 is attached to an endless belt 14A placed below the upstream sheet placing member 11A in such a way as to project from the upstream sheet placing member 11A. The endless belt 14A is spanned between an upstream drive pulley 15A and an upstream driven pulley 16A. The receiving member 13 is attached to an endless belt 14B placed below the downstream placing member 11B in such a way as to project from the downstream sheet placing member 11B. The endless belt 14B is spanned between a downstream drive pulley 15B and a downstream driven pulley 16B.

The push-out member 12 and the receiving member 13 are moved in accordance with the lengths of the sheets in the sheet conveying direction, so that the position of the sheets placed on the sheet placing members 11A and 11B is adjusted in the sheet conveying direction.

A couple of width aligning members 18A and a couple of width aligning members 18B, each of which aligns the positions in a width direction (a direction perpendicular to the sheet conveying direction) of the sheets with the center, are placed on the sheet placing members 11A and 11B, respectively. The width aligning members 18A are arranged on the upper surfaces of the upstream sheet placing member 11A at a predetermined intervals in a width direction. The width aligning members 18B are arranged on the upper surfaces of the downstream sheet placing member 11B at a predetermined intervals in a width direction. The width aligning members 18A and the width aligning members 18B are arranged in the direction parallel to the sheet conveying direction. The width aligning members 18A and 18B move in accordance with the widths of the sheets so as to align the widths of the sheets and to correct oblique passing of the sheets.

The staple apparatus 20 is placed above the end part of the downstream side of the upstream sheet placing member 11A.

The sheet folding part 30 is placed at the position corresponding to the gap D between the upstream sheet placing member 11A and the downstream sheet placing member 11B.

Figure 4:
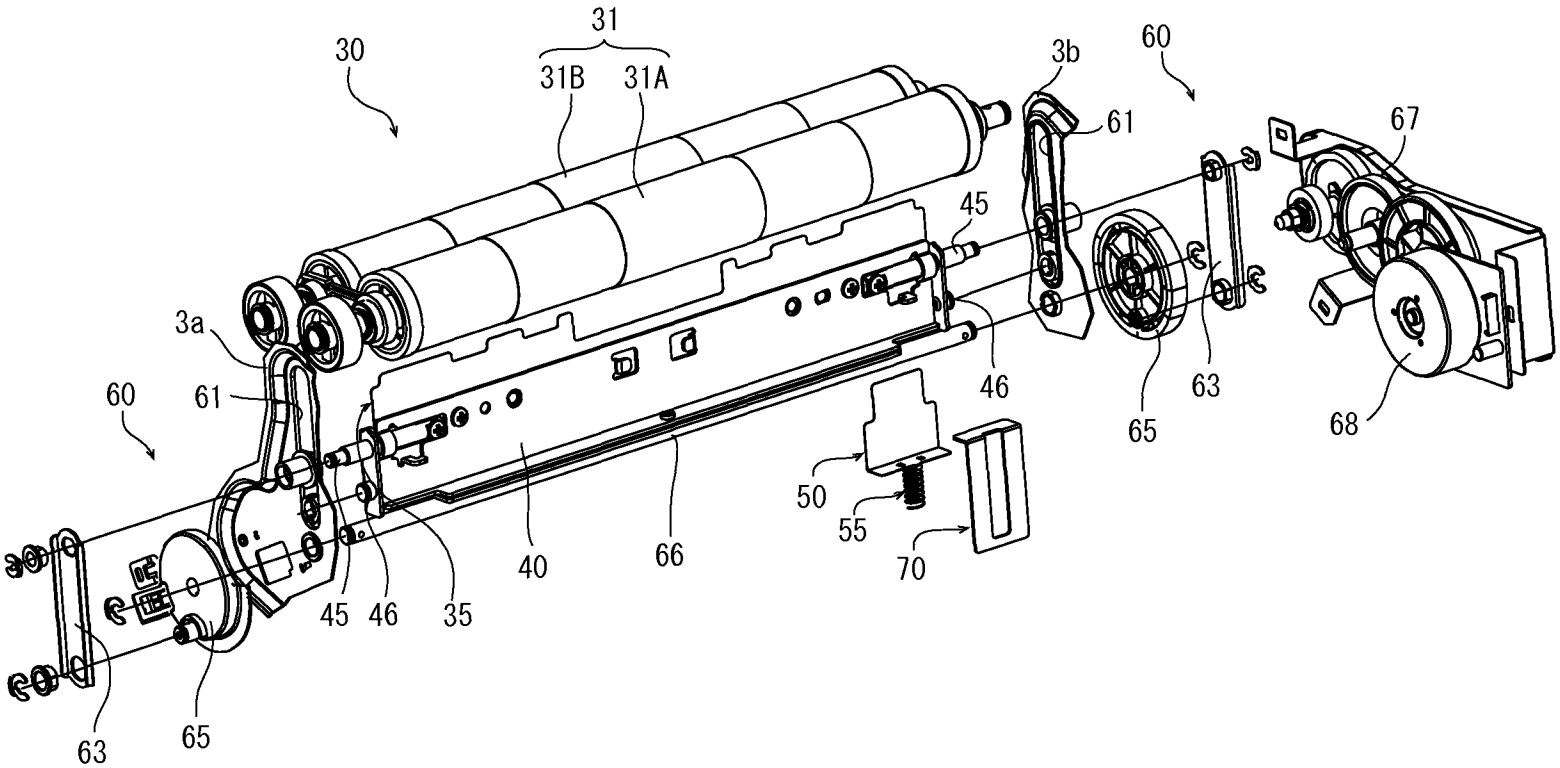
FIG. 4 is an exploded perspective view that shows a sheet folding part of an embodiment of a sheet folding apparatus in accordance with the present disclosure.
Figure 5:
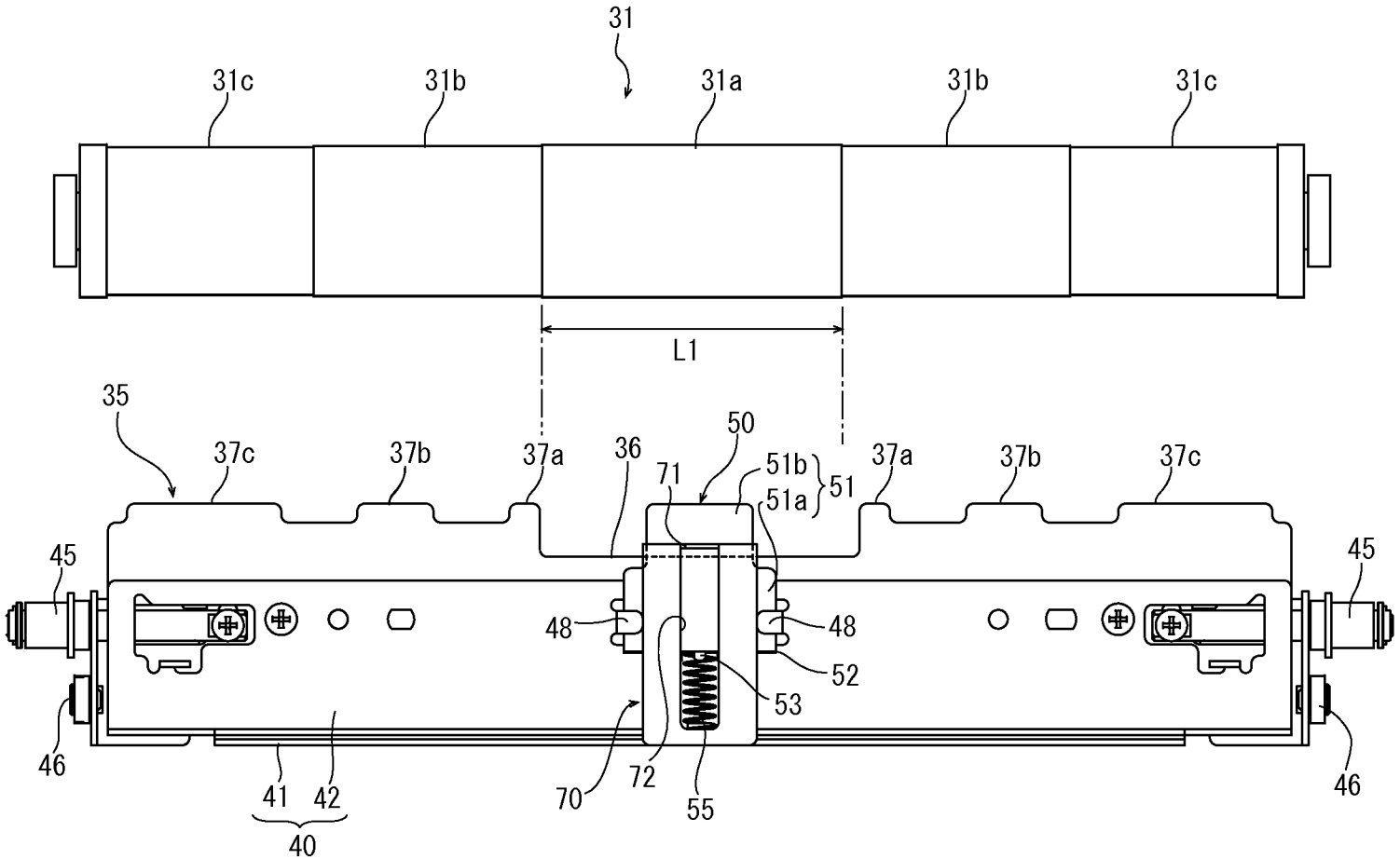
FIG. 5 is an elevation view that shows a two-folding roller and a folding plate of an embodiment of a sheet folding apparatus in accordance with the present disclosure.
Figure 6:
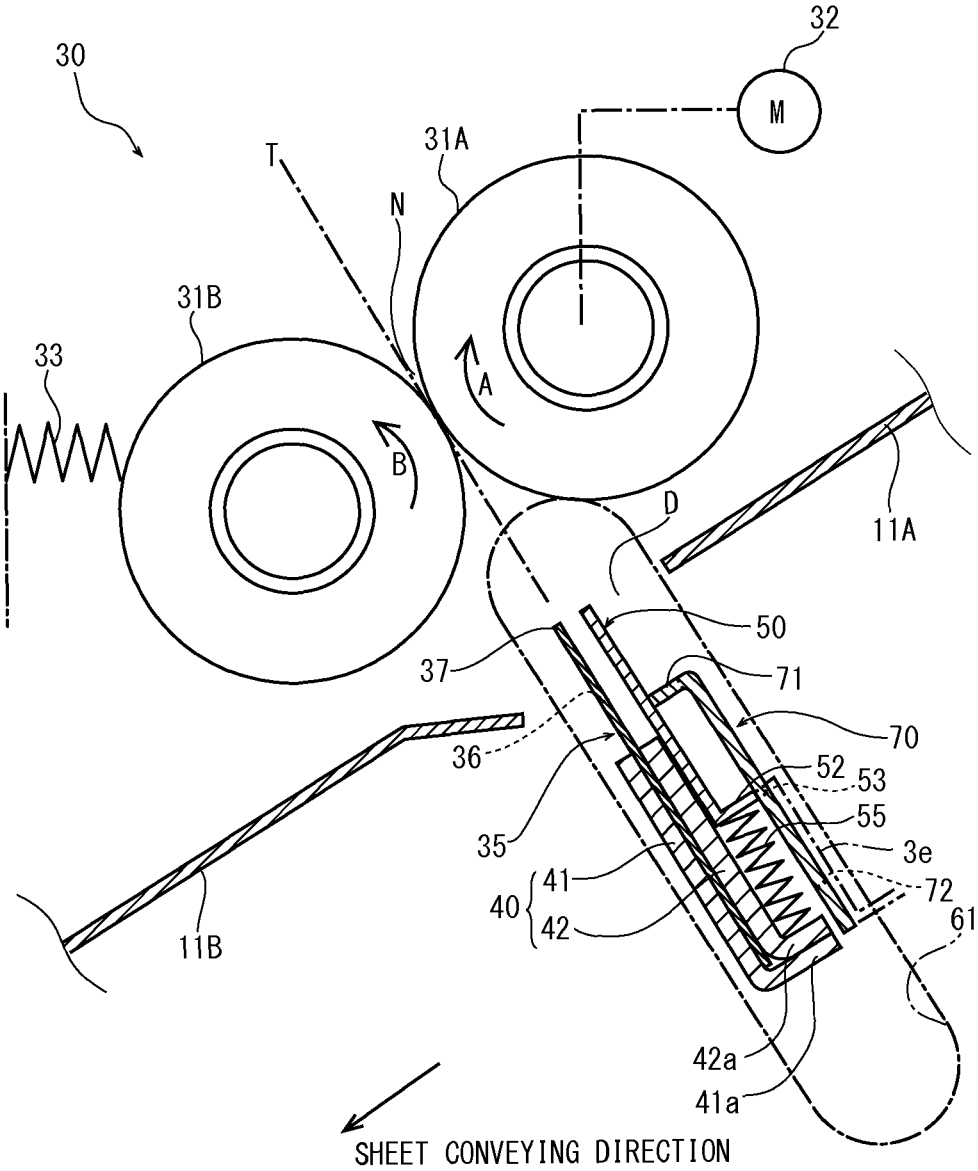
FIG. 6 is a sectional elevation view that shows a sheet folding part of an embodiment of a sheet folding apparatus in accordance with the present disclosure.

The sheet folding part 30 is described below and in FIG. 4 to FIG. 6. FIG. 4 is an exploded perspective view of the sheet folding part, FIG. 5 is an elevation view of a two-folding roller and a folding plate, and FIG. 6 is an elevation view of the sheet folding part. As shown in FIG. 4, the sheet folding part 30 has a couple of two-folding rollers 31, a folding plate 35 which can be inserted into the nip between the two-folding rollers 31, a folding plate support member 50, a drive mechanism. 60 which moves the folding plate 35 forward or downward, and a catching member 70 which limits the position of the folding plate support member 50.

As shown in FIG. 6, each of the two-folding rollers 31 is placed above the gap D between the upstream sheet placing member 11A and the downstream sheet placing member 11B. One of the two-folding rollers 31 is an upstream roller 31A, and the other of the two-folding rollers 31 is a downstream roller 31B, and both of the rollers 31A and 31B have the same shape as each other. As shown in FIG. 5, each of the two-folding rollers 31 is formed in such a manner that the outer diameter gradually (for example, in three steps) decreases from the central part to each end part in a longitudinal direction, and each of the two-folding rollers 31 includes a central part 31*a* with a large diameter, middle parts 31*b* with a middle-sized diameter located on both sides of the central part 31*a*, and end parts 31*c* with a small diameter located on the outer side of each middle part 31*b*.

As shown in FIG. 6, the upstream roller 31A and the downstream roller 31B are arranged parallel to each other in a direction approximately perpendicular to the sheet conveying direction, and a nip N is formed between the rollers 31A and 31B. Further, each of the rollers 31A and 31B is arranged in such a manner that the tangent line T passing through the nip N is approximately perpendicular to the sheet conveying direction.

The rotation shaft of the upstream roller 31A is connected to a motor 32 through gear arrays (not shown), and rotates in a clockwise direction in FIG. 6 (shown by arrow A). The downstream roller 31B is pushed by a coil spring 33 so as to be contact with the upstream roller 31A, and rotates in an anticlockwise direction in FIG. 6 (shown by arrow B) in accordance with the rotation of the upstream roller 31A.

As shown in FIG. 6, the folding plate 35 is arranged below the gap D between the upstream sheet placing member 11A and the downstream sheet placing member 11B, and is arranged opposite the two-folding rollers 31. As shown in FIG. 5, the folding plate 35 is a rectangle-shaped thin flat plate that extends in the lateral direction. The width of the folding plate 35 is approximately the same as the length in a longitudinal direction of each two-folding roller 31, and the thickness of the folding plate 35 is, for example, 0.3 mm.

A cutout part 36 is formed in the upper edge part of the folding plate 35. The cutout part 36 is formed in the position corresponding to the central part 31*a* of each two-folding roller 31. The cutout part 36 has a length, in a longitudinal direction, approximately the same as or slightly larger than the length L1 of the central part 31*a* of each two-folding roller 31, and has a depth that is set in such a manner that the cutout part 36 does not reach the nip N when the folding plate 35 is inserted into the nip N between the two-folding rollers 31.

Multiple (for example, three) projected piece parts 37 are formed on each side of the cutout part 36 of the folding plate 35. In the folding plate 35, the projected piece parts 37 each extend and are continuously arranged. Among the projected piece parts 37 on each side of the cutout part 36, one is an inside projected piece part 37*a* located on the outer side of the cutout part 36, another one is an intermediate projected piece part 37*b* located on the outer side of the inside projected piece part 37*a*, and the other is an outside projected piece part 37*c* located on the outer side of the intermediate projected piece part 37*b* and located on slightly inner side of the end of the folding plate 35. The arrangements of the projected piece parts 37 on both sides of the cutout part 36 have symmetry with respect to the center in a width direction of the folding plate 35.

Each projected piece part 37 has a height smaller than the depth of the cutout part 36, and the projected piece part 37 located near the end of the folding plate 35 is larger in width than the projected piece part 37 located near the center of the folding plate 35. Namely, the inside projected piece part 37*a* is the smallest, the outside projected piece part 37*c* is the largest, and the intermediate projected piece part 37*b* is intermediate between the inside projected piece part 37*a* and the outside projected piece part 37*c*, in width. The intervals between the projected piece parts 37 are approximately the same.

The folding plate 35 is supported by a support member 40. The support member 40 supports on the upstream side and the downstream side in the sheet conveying direction of the folding plate 35, and supports the part of the folding plate 35 located below the cutout part 36, and, as shown in FIG. 6, the support member 40 has a upstream support plate 41 and a downstream support plate 42. Each of the support plates 41 and 42 is a plate member shaped like an "L" in a side view. A support parts 41*a* is formed at a lower end of the support plate 41 by bending the support plate 41 approximately at a right angle to the upstream side, and a support parts 42*a* is formed at a lower end of the support plate 42 by bending the support plate 42 approximately at a right angle to the upstream side. The folding plate 35 is supported between the support plates 41 and 42, and is fixed to the support plates 41 and 42 with screws at multiple portions.

As shown in FIG. 5, pins 45 and 46 are attached to the upper part and the lower part of each end in a width direction of the support member 40, and the pins 45 and 46 project outwards. Hook-shaped holding projected parts 48 are formed approximately in the central part of the upstream support plate 42, and the holding projected parts 48 are arranged opposite to each other.

As shown in FIG. 4 and FIG. 6, the folding plate support member 50 is a plate member shaped like an "L" in a side view, and has a width smaller than that of the cutout part 36 of the folding plate 35. The folding plate support member 50 includes a body part 51 shaped like a rectangle that extends in a longitudinal direction, and a support part 52 shaped like a rectangle that extends in a lateral direction and formed by bending the lower end part of the body part 51 approximately at an right angle to the upstream side. As shown in FIG. 5, the body part 51 includes a base end part 51*a* with a large width and a leading end part 51*b* with a small width. A projected piece part 53 is formed at the center in a width direction of the end of the support part 52.

In the folding plate support member 50, the base end part 51*a* of the body part 51 is supported between the holding projected parts 48 formed in the upstream support plate 42. In such a manner, the folding plate support member 50 can slide with respect to the folding plate 35 in the height direction of the folding plate 35.

Figure 7:
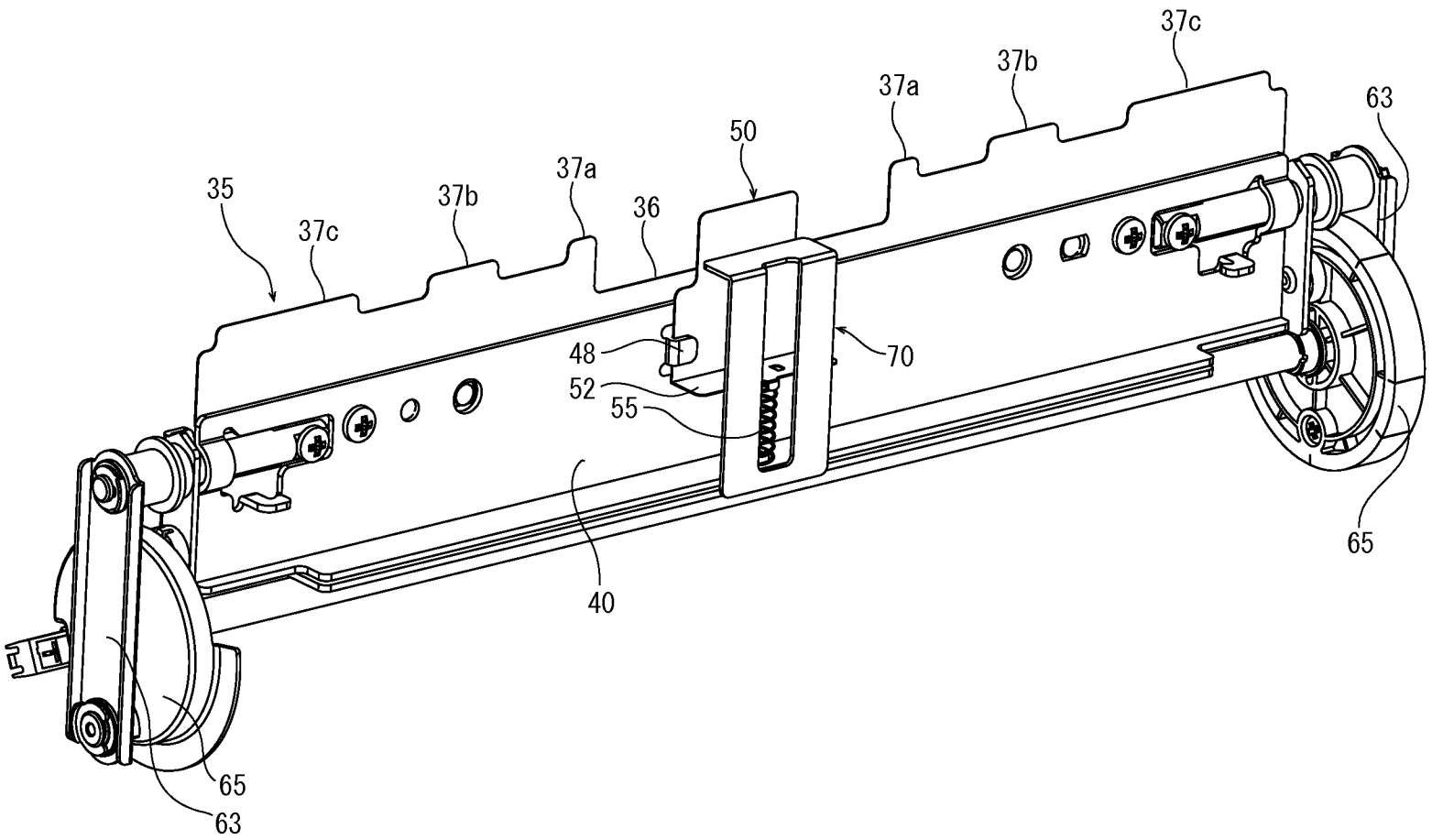
FIG. 7 is a perspective view that shows a folding plate and a folding plate support member when sheets are set in an embodiment of a sheet folding apparatus in accordance with the present disclosure.

Further, a coil spring 55 is placed between the support part 52 of the folding plate support member 50 and the support part 42*a* of the upstream support plate 42. The coil spring 55 pushes the folding plate support member 50 toward the upper edge of the folding plate 35. As shown in FIG. 5, FIG. 6 and FIG. 7, in the state where the folding plate support member 50 is pushed by the coil spring 55, the slide of the folding plate support member 50 is limited by a stopping mechanism, so that the end of the folding plate support member 50 projects from the cutout part 36 of the folding plate 35, and the position of the end of the folding plate support member 50 is approximately the same as the position of the end of each of the projected piece parts 37 in height. For example, the stopping mechanism may be formed in such a manner that the support part 52 of the folding plate support member 50 touches the lower end part of each holding projected part 48 formed in the upstream support plate 42 when the folding plate support member 50 is pushed upward by the coil spring 55.

As shown in FIG. 4, the drive mechanism 60 has a guide part 61 which guides the folding plate 35 in the direction that the folding plate 35 moves forward or backward, a crank arm 63 which is connected to the folding plate 35, and a disk-shaped cam 65 which rotates the crank arm 63.

The guide part 61 is a guide hole shaped like a long hole and formed in each of the front and back side boards 3*a* and 3*b* of the case 3 of the sheet folding apparatus 1. The guide part 61 is placed at the position corresponding to the nip N of the two-folding rollers 31 in each of the front and back side boards 3*a* and 3*b*, and extends in the direction along with the tangent line T of the nip N. The direction along with the tangent line T is the direction that the folding plate 35 moves forward or backward. The upper and lower pins 45 and 46 of the support member 40 enter each guide part 61.

One end of each crank arm 63 is rotatably connected to the upper pin 45 through the guide part 61. The other end of each crank arm 63 is rotatably connected to an axis part of the disk-shaped cam 65. Each disk-shaped cam 65 is supported so as to rotate around a rotation shaft 66. The disk-shaped cam 65 located on the back side is connected to the rotation shaft of a motor 68 though a gear array 67. In such a mechanism, when each disk-shaped cam 65 is rotated by the drive of the motor 68, the connection point of the crank arm 63 and the disk-shaped cam 65 moves along with the circular path. Then, through each crank arm 63, the folding plate 35 supported by the support member 40 reciprocates along with the guide part 61 between a retracting position, which is the lowest point of the connection point of the crank arm 63 and the disk-shaped cam 65 moving along with the circular path, and a progress position, which is the highest point of the connection point.

As shown in FIG. 5 and FIG. 6, the catching member 70 is a plate member shaped like an "L" in a side view. A caching part 71 is formed in the upper end of the catching member 70 by bending the upper end part of the catching member 70 approximately at a right angle to the downstream side. A slit part 72 is formed in the central part in a width direction of the catching member 70, and extends in the height direction.

As shown in FIG. 6, the catching member 70 is supported, by the support member 3*e* placed in the case 3, in such a manner that the catching part 71 faces the support part 52 of the folding plate support member 50, and the projected piece part 53 is inserted into the slit part 72 of the folding plate support member 50. In such a manner, when the folding plate support member 50 moves forward, the support part 52 of the folding plate support member 50 touches the catching part 71 of the catching member 70. The position where the support part 52 touches the catching part 71 is set at the position where the end of the folding plate support member 50 is not inserted into the nip N when the folding plate 35 fully moves forward.

As shown in FIG. 2, an ejection roller 81 is placed above the two-folding rollers 31. A canopy member 82 is swingably placed below the ejection roller 81. An ejection tray 83 is placed below the canopy member 82.

Figure 8:
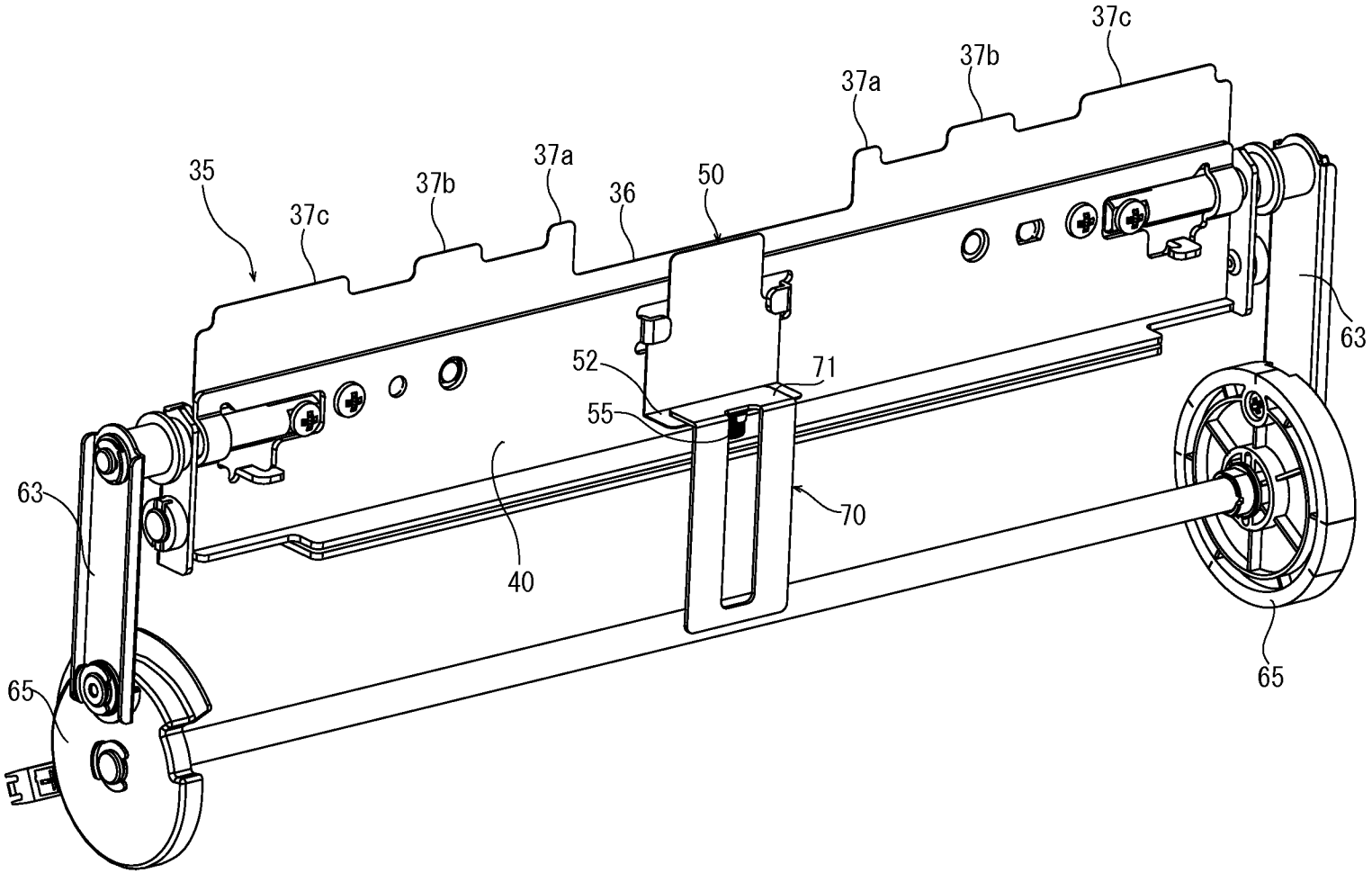
FIG. 8 is a perspective view that shows a folding plate and a folding plate support member when a folding process is performed in an embodiment of a sheet folding apparatus in accordance with the present disclosure.
Figure 9:
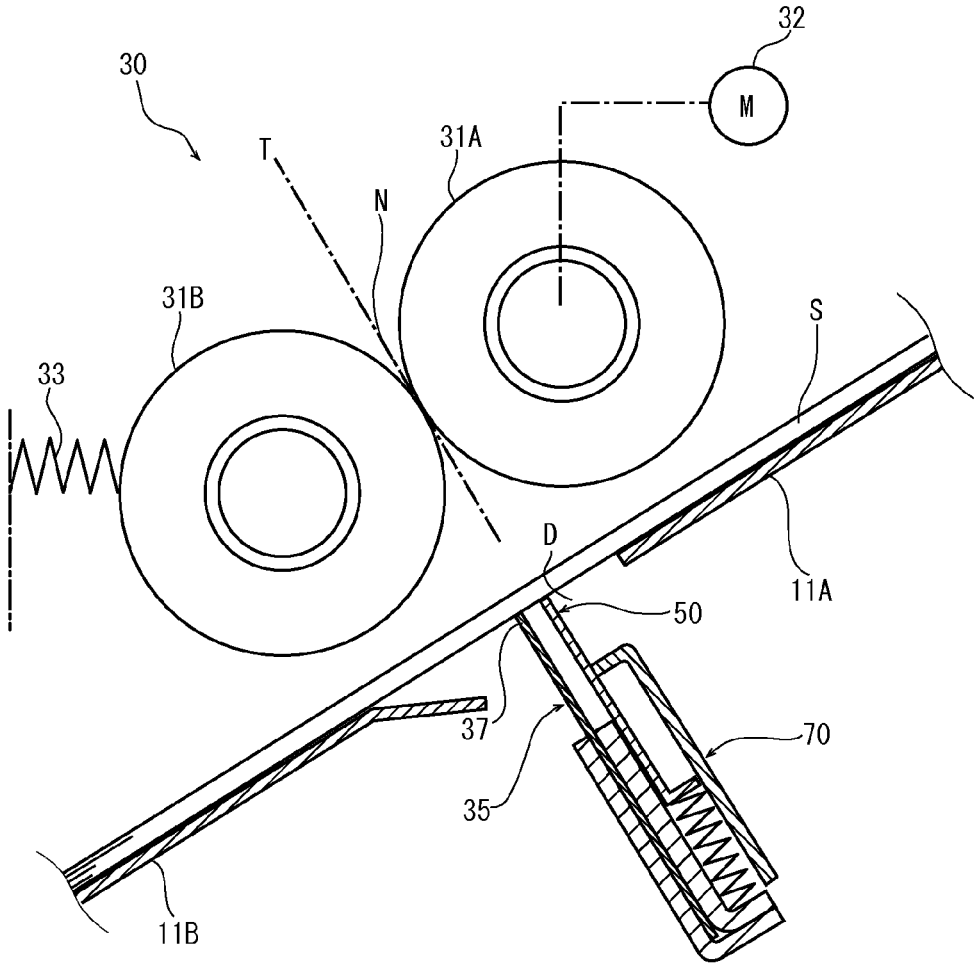
FIG. 9 is a sectional elevation view that shows a sheet folding part when sheets are set in an embodiment of a sheet folding apparatus in accordance with the present disclosure.
Figure 10:
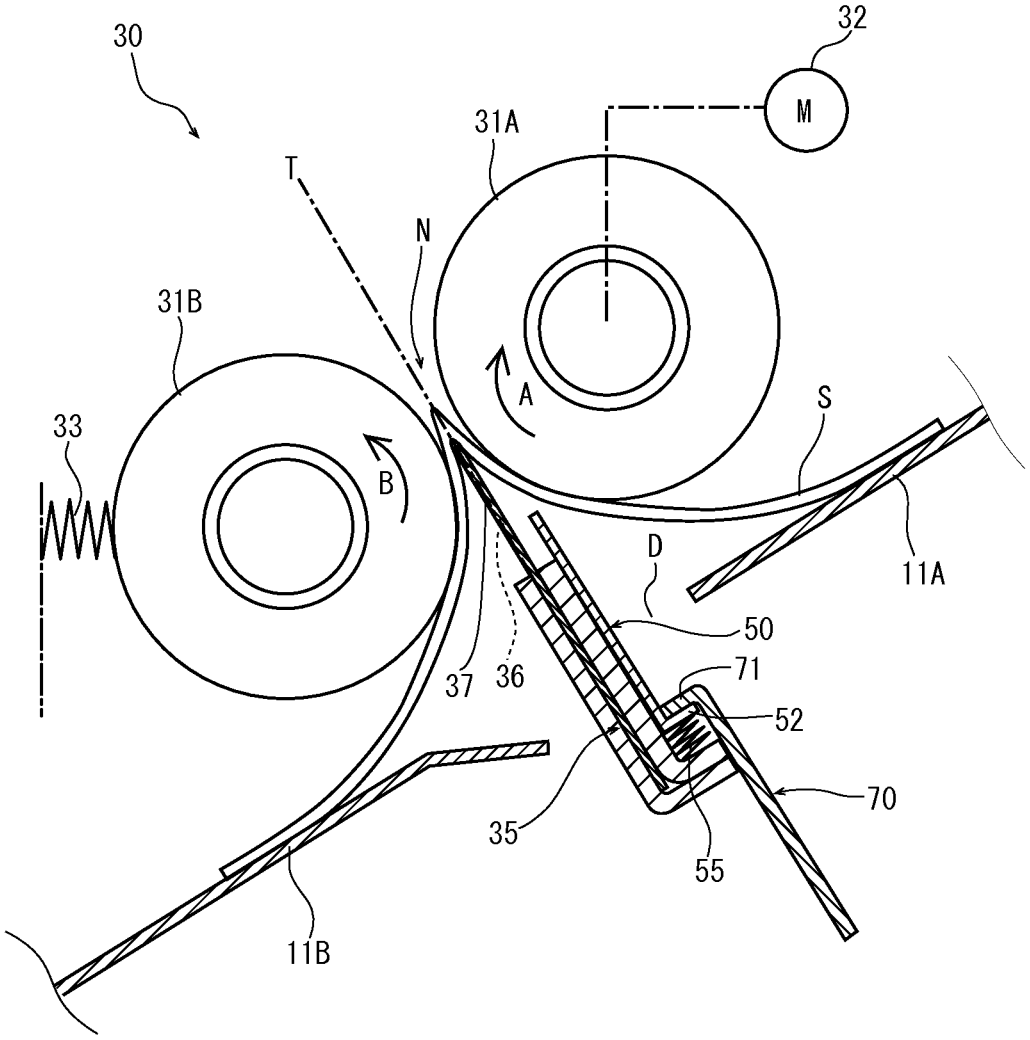
FIG. 10 is a sectional elevation view that shows a sheet folding part when a sheet folding process is performed in an embodiment of a sheet folding apparatus in accordance with the present disclosure.

The operation of the sheet folding part 30 with the above-described configuration is described below and in FIG. 2, FIG. 4 and FIG. 7 to FIG. 10. FIG. 7 is a perspective view that shows the folding plate and the folding plate support member when sheets are set. FIG. 8 is a perspective view that shows the folding plate and the folding plate support member when the sheets are folded. FIG. 9 is an elevation view that shows the folding plate and the folding plate support member when sheets are set. FIG. 10 is an elevation view that shows the folding plate and the folding plate support member when the sheets are folded.

As shown in FIG. 2, the sheets carried in the sheet post-processing apparatus 100 pass through the sheet carry-in path 5, and are placed on the upstream sheet placing member 11A and the downstream sheet placing member 11B. Then, the upper edges and the lower edges in a longitudinal direction of the sheets are aligned by the push-out member 12 and the receiving member 13, and both edges in a width direction of the sheets are aligned by the width aligning members 18A and 18B.

Thereafter, the sheets are conveyed on the sheet placing members 11A and 11B by the push-out member 12 and the receiving member 13, and the central parts in a longitudinal direction of the sheets are positioned at a staple position of the staple apparatus 20, and are stapled.

Next, the stapled sheets are conveyed on the sheet placing members 11A and 11B to the sheet folding part 30 by the push-out member 12 and the receiving member 13, and the central parts in a longitudinal direction of the sheets are set at the position corresponding to the nip N between the two-folding rollers 31 of the sheet folding part 30.

As shown in FIG. 7, when the sheets are set, the connection point of the crank arm 63 of the drive mechanism 60 and the disk-shaped cam 65 is positioned at the lowest point on the circular path, and the folding plate 35 is moved back to the retracting position. At this time, as shown in FIG. 9, the end of each of the projected piece parts 37 of the folding plate 35 and the upper surface of the sheet placing members 11A and 11B are in the same plane. The folding plate support member 50 is pushed by the coil spring 55 to the upper edge direction of the folding plate 35, and projects from the cutout part 36 of the folding plate 35, and the slide of the folding plate support member 50 is limited by the above-described stopping mechanism in such a way that the end of the folding plate support member 50 is the same in height as the end of each of the projected piece parts 37.

In this manner, as shown in FIG. 9, the respective end parts in a longitudinal direction of the sheets S are placed on the sheet placing members 11A and 11B, and the lower face of the central part of the sheets S (the lowest sheet among the sheets S) touches the end of each of the projected piece parts 37 and the end of the folding plate support member 50, so that the sheets S are supported so as to be along with the upper surfaces of the sheet placing members 11A and 11B and to extend approximately straight.

After the sheets S are set, the motor 68 of the drive mechanism 60 of the sheet folding part 30 shown in FIG. 4 is driven, and the disk-shaped cam 65 is rotated through the gear array 67. When the disk-shaped cam 65 is rotated, the support member 40 which supports the folding plate 35 moves forward along with the guide part 61. In this manner, the folding plate 35 and the folding plate support member 50 move toward the nip N, pushing the central part of the sheets S up. As show in FIG. 8, when the connection point of the crank arm 63 of the drive mechanism 60 and the disk-shaped cam 65 reaches the highest point on the circular path, and the folding plate 35 moves forward to the progress position, each of the projected piece parts 37 of the folding plate 35 enters the nip N.

The folding plate support member 50 moves forward together with the folding plate 35 toward the nip N at first. However, when the support part 52 of the folding plate support member 50 touches the caching part 71 of the catching member 70, the folding plate support member 50 moves downward with respect to the folding plate 35 against the pushing force of the coil spring 55, so that the folding plate support member 50 does not enter the nip N.

In the folding plate 35 located at the progress position show in FIG. 10, whereas each of the projected piece parts 37 is inserted into the nip N, the cutout part 36 is not inserted in the nip N. Namely, the folding plate 35 and the folding plate support member 50 are not inserted into the nip N between the central parts of the upstream and downstream rollers 31A and 31B.

Further, approximately at the same time as driving the motor 68 of the drive mechanism 60, the upstream roller 31A is driven by the motor 32, and is rotated in a clockwise direction in FIG. 9. Then, the downstream roller 31B is rotated in an anticlockwise direction in FIG. 9 in accordance with the rotation of the upstream roller 31A. In this manner, as shown in FIG. 10, the central parts of the sheets S are pushed up to the nip N by the folding plate 35, and are pressed from both sides by the upstream roller 31A and the downstream roller 31B, so that the sheets S are folded. Incidentally, the downstream roller 31B moves in a left direction by the distance corresponding to the thickness of the folded sheets S against the pushing force of the coil spring 33.

The folding plate 35 moves backward immediately after the folding plate 35 reaches the progress position, and the upstream roller 31A and the downstream roller 31B continue to rotate. In this manner, the folded sheets S are ejected from the nip N of the two-folding rollers 31 in such a manner that the folded central parts are ejected first.

As shown in FIG. 2, the ejected sheet S are conveyed toward the canopy member 82 by the ejection roller 81, and are ejected on the ejection tray 83. In this manner, the sheets whose central parts are stapled and folded are completed.

As described above, in the sheet folding apparatus 1 in accordance with an embodiment of the present disclosure, when the sheets are set, whereas the folding plate 35 does not touch the central part of the sheets (i.e., the central part of the lowest sheet among the sheets), the folding plate support member 50 touches the central part of the sheets (i.e., the central part of the lowest sheet among the sheets). Therefore, it is possible to support the sheets so as to prevent the central parts of the sheets from bending down. Further, the folding plate support member 50 moves forward to the nip N of the two-folding rollers 31 together with the folding plate 35 at first. Therefore, it is possible to insert the sheets into the nip N while keeping the sheets approximately straight. Consequently, it is possible to prevent the central parts of the sheets from being creased.

Further, when the sheets are folded in two, the folding plate 35 and the folding plate support member 50 do not enter the nip N between the central parts 31*a* of the two-folding rollers 31 with a large diameter. Therefore, it is possible to prevent gloss from being produced in the central part of the sheet when the folding plate 35 is moved backward. Consequently, it is possible to obtain a high quality two-folded sheets without any creases or any gloss.

Further, each of the two-folding rollers 31 is formed in such a manner that the outer diameter gradually decreases from the central part to each end part. Therefore, it is possible to make the pressure force in a longitudinal direction on the two-folding rollers 31 uniform and to reduce creases in the sheets. Furthermore, the multiple projected piece parts 37 are formed in the parts excepting the part corresponding to the central parts 31*a* of the two-folding rollers 31 in the edge of the folding plate 35, and the width of the projected piece part 37 located near the end of the folding plate 35 is larger than that of the projected piece part 37 located near the center of the folding plate 35. Therefore, it is possible to disperse the internal stress that the sheets receives when the folding plate 35 enters the nip N, and thereby, it is possible to prevent the sheets from being damaged.

While the present disclosure has been described with reference to the particular illustrative embodiments, it is not to be restricted by the embodiments. It is to be appreciated that those skilled in the art can change or modify the embodiments without departing from the scope and spirit of the present disclosure.

What is claimed is:

1. A sheet folding apparatus which folds a sheet of paper in two and comprises:

a couple of two-folding rollers each of whose outer diameter gradually decreases from the central part to each end part in a longitudinal direction thereof;

a folding plate which can move forward to or backward from a nip between the two-folding rollers, and has a cutout part which is located at an edge part of the folding plate facing the nip between central parts of the two-folding rollers, wherein the cutout part does not reach the nip between the central parts of the two-folding rollers when the sheet is folded;

a drive mechanism which moves the folding plate forward;

a folding plate support member which is placed at a position facing the nip between the central parts of the two-folding rollers, is slidably supported on the folding plate so as to be able to slide forward or backward with respect to the folding plate, and is always pushed forward by receiving a pushing force such that an end of the folding plate support member projects from the cutout part; and a catching member which moves the folding plate support member backward with respect to the folding plate against the pushing force by touching the folding plate support member, after the folding plate support member starts to move forward to the nip together with the folding plate by driving the drive mechanism and before the folding plate support member reaches the nip.

2. A sheet folding apparatus according to claim 1, wherein a plurality of projected piece parts are formed in a part excepting a part where the cutout part is formed of an edge of the folding plate, each of the plurality of projected piece parts projects toward the nip and enters the nip when the sheet is folded.

3. A sheet folding apparatus according to claim 1, wherein an end part of the folding plate support member touches the sheet and supports the sheet when the sheet is set between the two-folding rollers and the folding plate.

4. A sheet folding apparatus according to claim 1, wherein the folding plate support member is moved toward the nip between the two-folding rollers together with the folding plate when the folding plate is started to be moved toward the nip, and then, moving of the folding plate support member is limited so as to stay in a position where the folding plate support member does not reach the nip, before the folding plate enters the nip.

5. A sheet folding apparatus according to claim 1, wherein each of the two-folding rollers has at least a large diameter part and a small diameter part, and the cutout part and the folding plate support member are located in a position corresponding to the large diameter parts of the two-folding rollers, and do not enter the nip between the large diameter parts of the two-folding rollers when the sheet is folded, and a part excepting a part where the cutout part is formed of an edge of the folding plate is located at a position corresponding to the small diameter parts of the two-folding rollers, and enters the nip between the small diameter parts of the two-folding rollers when the sheet is folded.

6. A sheet post-processing apparatus comprising the sheet folding apparatus according to claim 1.

* * * * *